US011161636B2

(12) United States Patent
Marin et al.

(10) Patent No.: US 11,161,636 B2
(45) Date of Patent: Nov. 2, 2021

(54) METHODS AND DEVICES FOR FILLING CUPS, PACKAGING LINES FOR CUPS

(71) Applicant: SYNERLINK, Puiseux Pontoise (FR)

(72) Inventors: Eric Marin, Les Alluets le Roi (FR); Paul Le Roi, Ris Orangis (FR); Patrick Dechezelle, Noisy-sur-Ecole (FR)

(73) Assignee: SYNERLINK, Puiseux Pontoise (FR)

( * ) Notice: Subject to any disclaimer, the term of this patent is extended or adjusted under 35 U.S.C. 154(b) by 278 days.

(21) Appl. No.: 16/345,091

(22) PCT Filed: Oct. 25, 2017

(86) PCT No.: PCT/FR2017/052943
§ 371 (c)(1),
(2) Date: Apr. 25, 2019

(87) PCT Pub. No.: WO2018/078286
PCT Pub. Date: May 3, 2018

(65) Prior Publication Data

US 2019/0248526 A1 Aug. 15, 2019

(30) Foreign Application Priority Data

Oct. 25, 2016 (FR) ..... 16 60331

(51) Int. Cl.
*B65B 25/00* (2006.01)
*B65B 3/02* (2006.01)
(Continued)

(52) U.S. Cl.
CPC ..... *B65B 39/004* (2013.01); *B65B 3/02* (2013.01); *B65B 3/022* (2013.01); *B65B 3/26* (2013.01);
(Continued)

(58) Field of Classification Search
CPC ..... B65B 2210/08; B65B 25/001; B65B 3/02; B65B 3/022; B65B 3/26; B65B 39/004; B65B 39/001; B65B 39/00; F16K 23/00
(Continued)

(56) References Cited

U.S. PATENT DOCUMENTS 3,865,281 A * 2/1975 Byrd ..... B65B 43/44 222/252
5,344,052 A * 9/1994 Divall ..... B65B 39/004 222/135
(Continued)

FOREIGN PATENT DOCUMENTS

DE 199 63 762 A1 7/2001
FR 3021715 A1 12/2015

OTHER PUBLICATIONS

"Testimonial Albalact" presentation by Synerlinkand published on May 7, 2015, retrieved from URL https://www.youtube.com/watch?v=lj7sG64cado on Mar. 24, 2021 (Year: 2015).*
(Continued)

*Primary Examiner* — Valentin Neacsu
(74) *Attorney, Agent, or Firm* — Nixon & Vanderhye

(57) ABSTRACT

Disclosed is a method for filling cups in which: a cup is brought and held vertically with and opposite a distribution nozzle; next, the blocking rod is brought into the open position and the cup is filled with a product flowing through the distribution nozzle; when a preferred quantity of product is present in a cup, the blocking rod is brought into the closed position and a product flow is stopped; the blocking rod is brought into a contact position in which the blocking rod extends out of the distribution nozzle through the distribution opening such that a lower end of the blocking rod comes in the contact with the product upper-surface.

22 Claims, 7 Drawing Sheets

(51) Int. Cl.

| | |
|---|---|
| ***B65B 3/26*** | (2006.01) |
| ***B65B 39/00*** | (2006.01) |
| ***B67C 3/26*** | (2006.01) |
| ***B67C 3/28*** | (2006.01) |

(52) U.S. Cl.
CPC ..... *B65B 25/001* (2013.01); *B67C 3/2608* (2013.01); *B67C 3/28* (2013.01); *B65B 2210/08* (2013.01)

(58) Field of Classification Search
USPC ..... 53/558; 141/311 A; 222/571, 559
See application file for complete search history.

(56) References Cited

U.S. PATENT DOCUMENTS

| | | | | |
|---|---|---|---|---|
| 6,070,622 | A * | 6/2000 | Rutter | B65B 39/004 141/10 |
| 6,148,874 | A * | 11/2000 | Rutter | B65B 39/004 141/10 |
| 6,996,956 | B2 * | 2/2006 | Sperry | B31D 5/0078 141/90 |
| 8,511,047 | B2 * | 8/2013 | Mahon | B29B 7/806 53/553 |
| 9,938,132 | B2 | 4/2018 | Thomas et al. | |
| 2016/0207645 | A1 * | 7/2016 | Meyer | B65B 1/30 |

OTHER PUBLICATIONS

International Search Report, dated Jan. 19, 2018, from corresponding PCT application No. PCT/FR2017/052943.

* cited by examiner

METHODS AND DEVICES FOR FILLING CUPS, PACKAGING LINES FOR CUPS

BACKGROUND OF THE INVENTION

Field of the Invention

The invention relates to filling containers or cups, for example filling containers with food liquids.

The invention relates in particular to filling cups with homogeneous contents, containing liquid or pasty products, or heterogeneous products containing a mixture of at least two among liquid, pasty or solid products. Examples of such contents are in particular liquid products or preparations (e.g. fruits, vegetables, etc.) with a liquid binder, in particular dairy products or braised, brewed, liquid or whipped cream, and foam type desserts with pieces of fruit, syrups, honey, caramel or even dry or granular products; this list is not limiting.

Description of the Related Art

The term "cup" must be understood broadly as comprising cups strictly speaking, but also trays, tubs or any other analogous primary form of packaging. The cups can be single cups or packs comprising several cups side-by-side and attached to each other by arrangement in columns or rows with breakable lines or zones with less resistance between them. For example, a pack can comprise two cups, or four cups arranged in two rows each comprising two cups, or even six cups in two rows comprising three cups each.

To fill a food cup with this type of food product, known devices for filling cups comprise, for example:

- At least one distribution nozzle extending along a vertical direction and ending in a lower end, where the distribution nozzle comprises a central channel extending along the vertical direction and ending in a distribution opening at the lower end of the distribution nozzle;
- A product intake channel connecting with the central channel of the distribution nozzle through an intake opening of the central channel, so as to define a distribution portion of the central channel between the intake opening and the distribution opening of the central channel;
- A blocking rod at least partially received in the central channel and movable along the vertical direction in the central channel between at least:
  - An open position in which said blocking rod leaves the distribution portion of the central channel free so as to allow a flow of product from the intake channel to the distribution opening; and
  - A closed position in which said blocking rod blocks the distribution portion of the central channel so as to prevent a flow of product from the intake channel to the distribution opening;
- Means for movement of the blocking rod movable between at least the open position and the closed position.

With such a filling device, a cup can be filled and a desired quantity of product dispensed into the cup. Such a device is for example shown in document FR 3,021,715.

A method for filling cups using such a cup filling device is for example implemented in the following way.

A cup is brought and held vertically with and opposite the distribution opening of the distribution nozzle.

Then, the blocking rod is brought down into an open position in which said blocking rod leaves the distribution portion of the central channel free so as to allow a flow of product from the intake channel to the distribution opening; and the cup is filled with the product flowing through the distribution opening of the nozzle.

When a preferred quantity of product is present in the cup, the blocking rod is brought into a closed position in which said blocking rod blocks the distribution portion of the central channel so as to stop flow of product from the intake channel to the distribution opening.

Finally, the cup is moved aside from the vertical of the distribution opening of the distribution nozzle and the cup is cleared.

In practice, a filling device can comprise several distribution nozzles so as to fill several cups at the same time, said distribution nozzles being mounted for example on a chassis. The cups can be separated from each other or form a pack of cups secured to each other.

Once the method is finished, another set of cups or a single cup can be brought in and the method repeated.

Such a filling method and device however have disadvantages.

In fact, when the blocking rod is brought in the closed position, the residual product can remain present in the central channel of the distribution nozzle, in particular near the distribution opening or on the lower end of the blocking rod if it extends past the distribution opening. This can result from the more or less viscous and sticky nature of the product measured or simply from the effect of the surface tension of the product.

This residual product can fall on the rim of the cup just filled when it is cleared, or on, or in, the following cup when it is brought vertically with the distribution opening.

Such an uncontrolled drop of residual product can lead to problems that are both technical, for example a poor seal of the cover of the cup, and qualitative, for example presence of a product X in a cup thought to contain a product Y and/or presence of a drop on the rim of cup Y.

The problem at the base of the invention is therefore to propose a method and a device for filling cups which reduces or avoids the presence of residual product after filling a cup, in particular near the distribution opening or on the lower end of the blocking rod. The invention also aims to allow filling of cups of all sizes and in particular of small dimensions. The invention again aims to propose such a method and such a conveying device which is low cost and easily adaptable.

BRIEF SUMMARY OF THE INVENTION

For this purpose, a first object of the invention is a method for filling cups in which: There is a device for filling cups, for example cups of yogurt, comprising:

- At least one distribution nozzle extending along a vertical direction and ending in a lower end, where the distribution nozzle comprises a central channel extending along the vertical direction and ending in a distribution opening at the lower end of the distribution nozzle;
- A product intake channel connecting with the central channel of the distribution nozzle through an intake opening of the central channel, so as to define a distribution portion of the central channel between the intake opening and the distribution opening of the central channel;
- A blocking rod at least partially received in the central channel and movable along the vertical direction in the central channel:

Means for movement of the blocking rod able to move the blocking rod;

A cup is brought and held vertically with and opposite the distribution opening of the distribution nozzle.

The blocking rod is brought down into an open position in which said blocking rod leaves the distribution portion of the central channel free so as to allow a flow of product from the intake channel to the distribution opening; and the cup is filled with the product flowing through the distribution opening of the distribution nozzle:

When a preferred quantity of product is present in the cup, the blocking rod is brought into a closed position in which said blocking rod blocks the distribution portion of the central channel so as to stop flow of product from the intake channel to the distribution opening.

The method is such that when the preferred quantity of product is present in the cup, said quantity of product forming a layer of product in the cup, said layer of product has a product upper-surface opposite from and vertically with the distribution opening of the distribution nozzle;

The blocking rod is brought into a contact position in which the blocking rod extends out of the distribution nozzle through the distribution opening such that a lower end of the blocking rod comes in the contact with the product upper-surface.

In preferred embodiments of the invention, one and/or another of the following dispositions could be used:

the cup is of the type having a bottom wall, a lateral wall closed on itself, and a top opening, and, in the contact position, the blocking rod enters inside the cup by the top opening and the lower end of the blocking rod is surrounded by the lateral wall of the cup;

when the blocking rod is in the contact position, the blocking rod further blocks the distribution portion of the central channel of the distribution nozzle;

the blocking rod is brought from the open position to the closed position and then the blocking rod is brought from the closed position to the contact position by means of a single, uninterrupted movement of vertical translation of the blocking rod from the open position to the contact position;

the distribution nozzle does not go inside the cup during implementation of the method, in particular the distribution nozzle is immobile relative to the cup along the vertical direction while the blocking rod is brought into the open position and while the cup is filled with a product flowing through the distribution opening of the distribution nozzle;

the distribution nozzle is arranged outside the cup while the blocking rod is brought into the open position and while the cup is filled with a product flowing through the distribution opening of the distribution nozzle;

in the open position of the blocking rod, the lower end of the blocking rod is received in the central channel, in particular received in a guiding portion of the central channel located upstream from the distribution portion of the central channel;

in the closed position of the blocking rod, the lower end of the blocking rod is received in the distribution portion of the central channel or is arranged outside of the distribution nozzle, in particular arranged outside of the distribution nozzle and near the lower end of the distribution nozzle, for example arranged outside the distribution nozzle and at a distance of less than 2 cm from the lower end of the distribution nozzle, measured along the vertical direction;

after having brought the blocking rod into the contact position,

The blocking rod is brought into a released position in which the blocking rod leaves the cup free to be moved, in particular free to be moved in a horizontal plane perpendicular to the vertical direction and blocks the distribution portion of the central channel so as to prevent the flow of product from the intake channel to the distribution opening, then, the cup is moved aside from the vertical of the distribution opening of the distribution nozzle and the cup is cleared;

in the released position of the blocking rod, the lower end of the blocking rod is received in the central channel of the distribution nozzle or is arranged outside of the distribution nozzle, in particular arranged outside of the distribution nozzle and near the lower end of the distribution nozzle, for example arranged outside the distribution nozzle and at a distance of less than 2 cm from the lower end of the distribution nozzle, measured along the vertical direction, In particular, in the released position, the blocking rod extends outside the distribution nozzle over a release distance less than the contact distance over which the blocking rod extends in the contact position;

the closed position and the released positioned of the blocking rod are identical;

after moving the cup aside from the vertical of the distribution opening of the distribution nozzle, another cup is brought vertically with and opposite the distribution opening of the distribution nozzle and the steps of the method are repeated.

An object of the invention is also a device for filling cups, for example cups of yogurt, for implementing a method such as detailed above, where the device comprises:

At least one distribution nozzle extending along a vertical direction and ending in a lower end, where the distribution nozzle comprises a central channel extending along the vertical direction and ending in a distribution opening at the lower end of the distribution nozzle;

An intake channel for this product connecting with the central channel of the distribution nozzle through an intake opening from the central channel, so as to define a distribution portion of the central channel between the intake opening and the distribution opening of the central channel;

A blocking rod at least partially received in the central channel and movable along the vertical direction in the central channel between at least:

An open position in which said blocking rod leaves the distribution portion of the central channel free so as to allow a flow of product from the intake channel to the distribution opening; and A closed position in which said blocking rod blocks the distribution portion of the central channel so as to prevent a flow of product from the intake channel to the distribution opening;

Means for movement of the blocking rod movable between at least the open position and the closed position.

The device is further such that:

The blocking rod is further placeable in a contact position in which the blocking rod extends through the distribution opening outside of the distribution nozzle over a contact distance—measured along the vertical direction between the distribution opening and the lower end of the blocking rod—greater than or equal to a maximum transverse dimension of the blocking rod measured in a plane perpendicular to the vertical direction (Z);

The means for moving the blocking rod are further able to bring the blocking rod into the contact position.

In preferred embodiments of the invention, one and/or another of the following dispositions could be used:

In the contact position, the blocking rod extends outside the distribution nozzle over a contact distance greater than or equal to twice the maximum transverse dimension of the blocking rod;

The blocking rod comprises, upstream from the lower end, a cylindrical blocking portion suited for blocking the distribution portion of the central channel of the distribution nozzle when the blocking rod is in the contact position and in the closed position, in particular the cylindrical blocking portion is suited for blocking the intake opening of the central channel when the blocking rod is in the contact position and in the closed position;

The blocking rod moves between the open position and the contact position through an extension distance along the vertical direction, and the cylindrical blocking portion of the blocking rod extends along the vertical direction over an extension length greater than or equal to said extension distance;

A section of the cylindrical blocking portion of the blocking rod, taken perpendicular to the vertical direction, is substantially identical to a section of the distribution portion of the central channel of the distribution nozzle;

The distribution nozzle extends along a vertical direction over a nozzle extension length, the blocking rod extends along the vertical direction over a rod extension length, and the rod extension length is greater than the nozzle extension length, preferably the rod extension length is greater than the nozzle extension length by at least one times the maximum transverse dimension of the blocking rod, even more preferably the rod extension length is greater than the nozzle extension length by at least two times the maximum transverse dimension of the blocking rod;

In the contact position, the blocking rod extends outside the distribution nozzle over a contact distance greater than or equal to 5 cm, preferably greater than or equal to 7 cm;

The lower end of the distribution rod has a conical shape, preferably ending in a rounded point;

The blocking rod does not have distribution openings, in particular the blocking rod is solid.

An object of the invention is also a cup packaging line comprising:

Means for producing cups, able to shape a plastic sheet to get at least one cup of the type having a bottom wall, a lateral wall closed on itself, and a top opening;

A device for filling cups such as detailed above;

Means for conveying and holding able to bring and hold at least one cup vertically with and opposite the distribution opening of at least one distribution nozzle of the cup filling device, and to move said cup aside from the vertical of said distribution opening of the distribution nozzle and to clear said cup.

According to an embodiment, the means for producing cups, the cup filling device, and the means for conveying and holding are arranged such that a separation, measured along the vertical direction between, first, the top opening of a cup brought and held vertically with and opposite the distribution opening of at least one distribution nozzle of the device and second the lower end of said distribution nozzle is less than the contact distance over which the blocking rod extends in the contact position, such that the blocking rod in the contact position enters inside the cup by the top opening, where the lower end of the blocking rod is surrounded by the lateral walls of the cup.

BRIEF DESCRIPTION OF THE DRAWINGS

The invention will be better understood and other goals, advantages and characteristics thereof will appear more clearly upon reading the following description which is made in light of the attached drawings, in which.

DETAILED DESCRIPTION OF THE PREFERRED EMBODIMENTS

Figure 1:
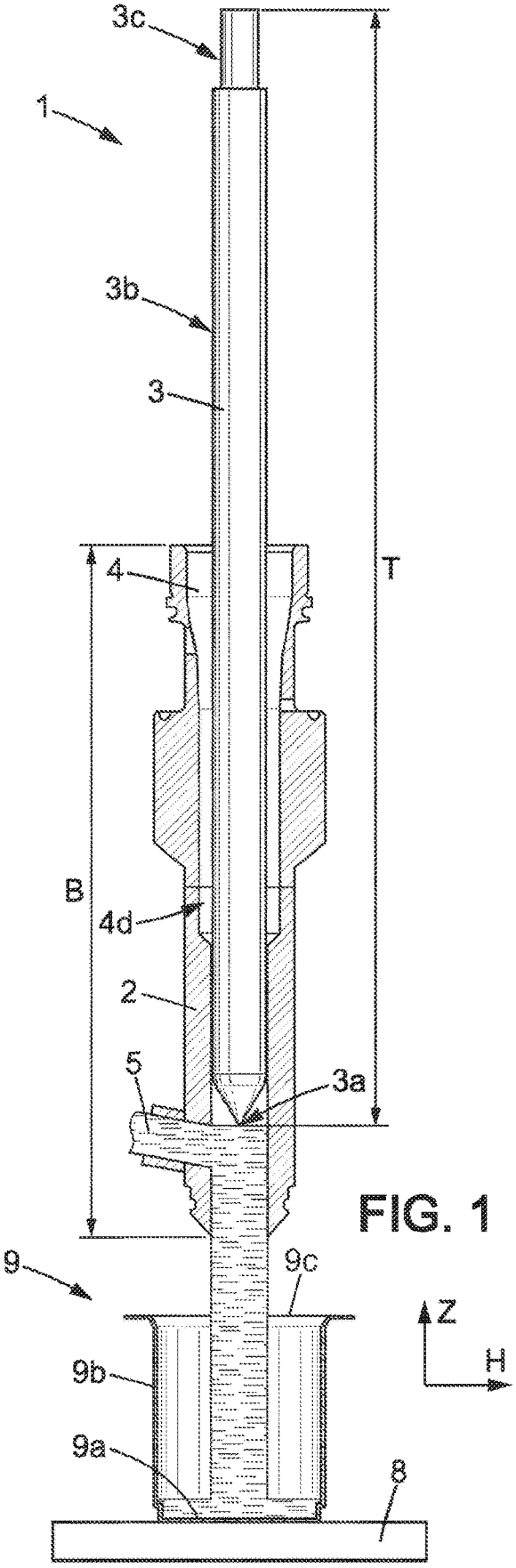
FIG. 1 shows in sectional side view a distribution nozzle and a blocking rod for a cup filling device conforming to the invention with the blocking rod in an open position.
Figure 8A:
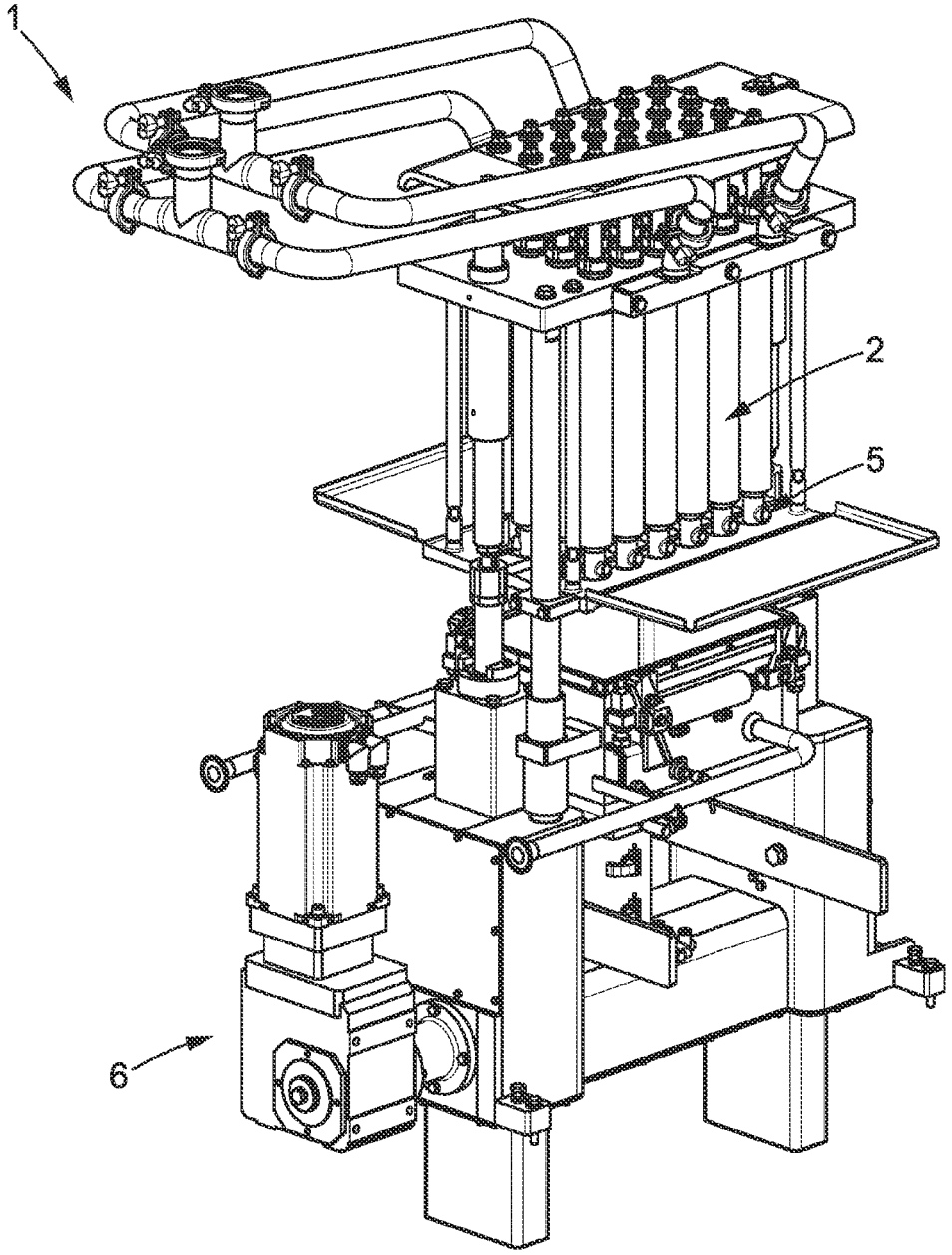
FIGS. 8A and 8B show a perspective and an elevation view of the cup filling device according to the invention.
Figure 8B:
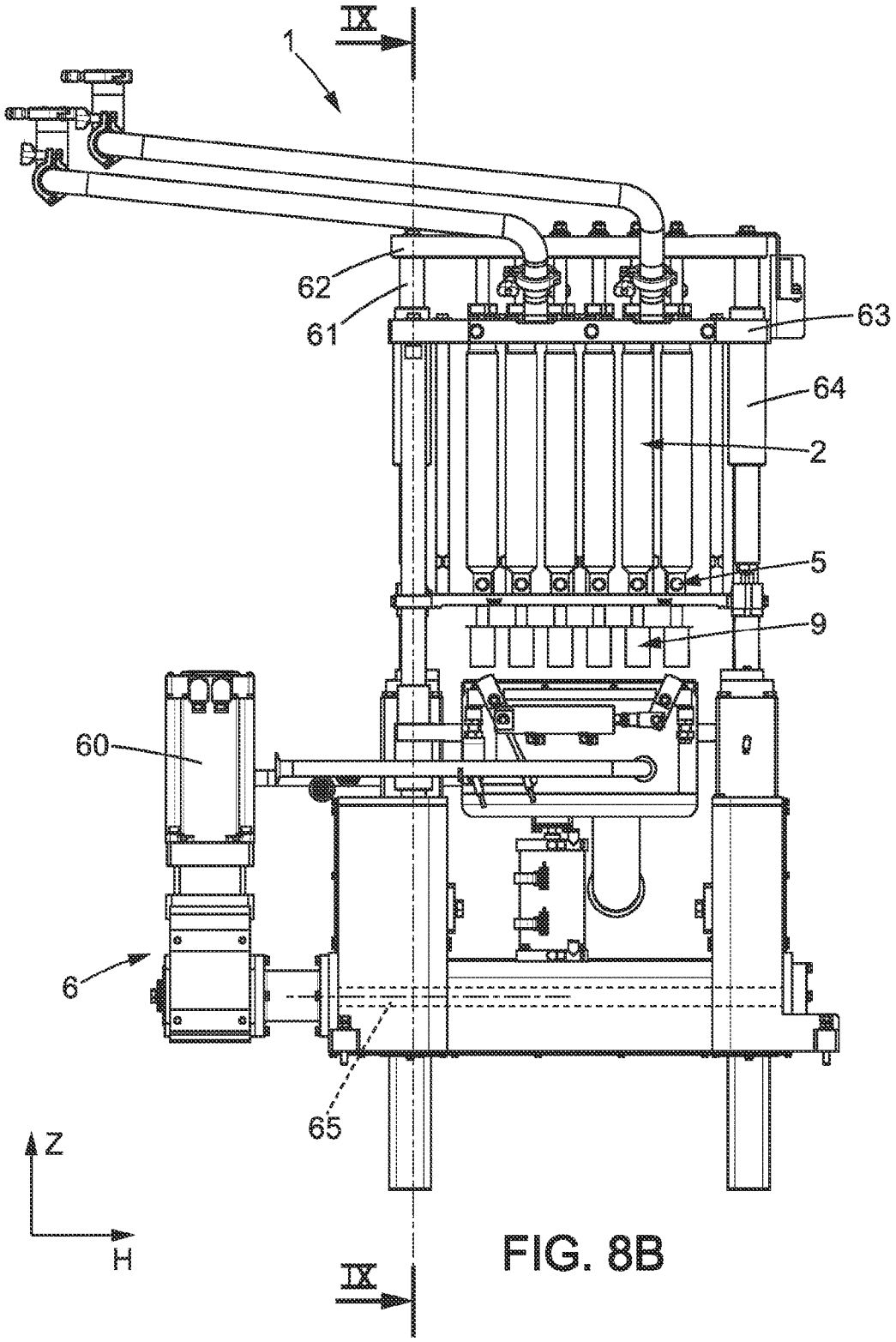

FIG. 1 shows a distribution nozzle 2 and a blocking rod 3 for a cup filling device 1 according to the invention, for example such as shown in FIGS. 8A and 8B.

The distribution nozzle 2 extends along a vertical direction Z and ends in a lower end 2*a*.

In the following description when referring to positional qualifiers such as the terms "top", "high", "bottom", "downstream", "upstream", "above", "below", "upper", "lower", "radial" or "axial", these terms are defined relative to the vertical Z direction unless otherwise indicated.

Unless otherwise specified, the expressions, "approximately", "substantially", "about", "of the order of", etc. mean that a slight variation relative to the nominal value considered his possible, notably of a small percentage, in particular within 10%.

The distribution nozzle 2 comprises a central channel 4. The central channel 4 extends along the vertical direction Z and ends in a distribution opening 4*a* at the lower end 2*a* of the distribution nozzle 2.

The distribution nozzle 2 can have a shape of revolution, for example cylindrical, and can be mounted on a chassis by bracing or screwing, for example on a chassis receiving several distribution nozzles 2.

The device 1 comprises a product intake channel 5. The product intake channel 5 can be an integral part of the distribution nozzle 2 or be formed by an additional part attached onto the distribution nozzle 2.

The product intake channel 5 is connected with the central channel 4 of the distribution nozzle by an intake opening 4*b* of the central channel 4.

A distribution portion 4*c* of the central channel 4 is thus defined between the intake opening 4*b* and the distribution opening 4*a*.

The blocking rod 3 extends substantially along the vertical direction Z and ends in the lower end 3*a*.

The blocking rod 3 is at least partially received in the central channel 4 of the distribution nozzle 2. The blocking rod 3 is movable along the vertical direction Z in the central channel 4, for example by sliding. The blocking rod 3 can for example be centered and held in the distribution nozzle by guiding orifices arranged in the central channel 4.

The blocking rod 3 is movable along the vertical direction Z between an open position, a closed position and a contact position. The blocking rod 3 can further be adapted to move into a released position, where said released position can be identical to the closed position, as is described later.

The open, closed, contact and release positions of the blocking rod 3 are successively shown for example in FIGS. 1, 3, 5 and 7.

These positions of the blocking rod 3 can in particular be ordered from top to bottom as follows: open position then closed position and released positioned then contact position. In this way, in the open position the blocking rod is in the highest position thereof, and in contact position, the blocking rod is in the lowest position thereof. The closed and release positions are therefore intermediate positions between the open position and the contact position, as applicable identical intermediate positions as indicated later.

Figure 9:
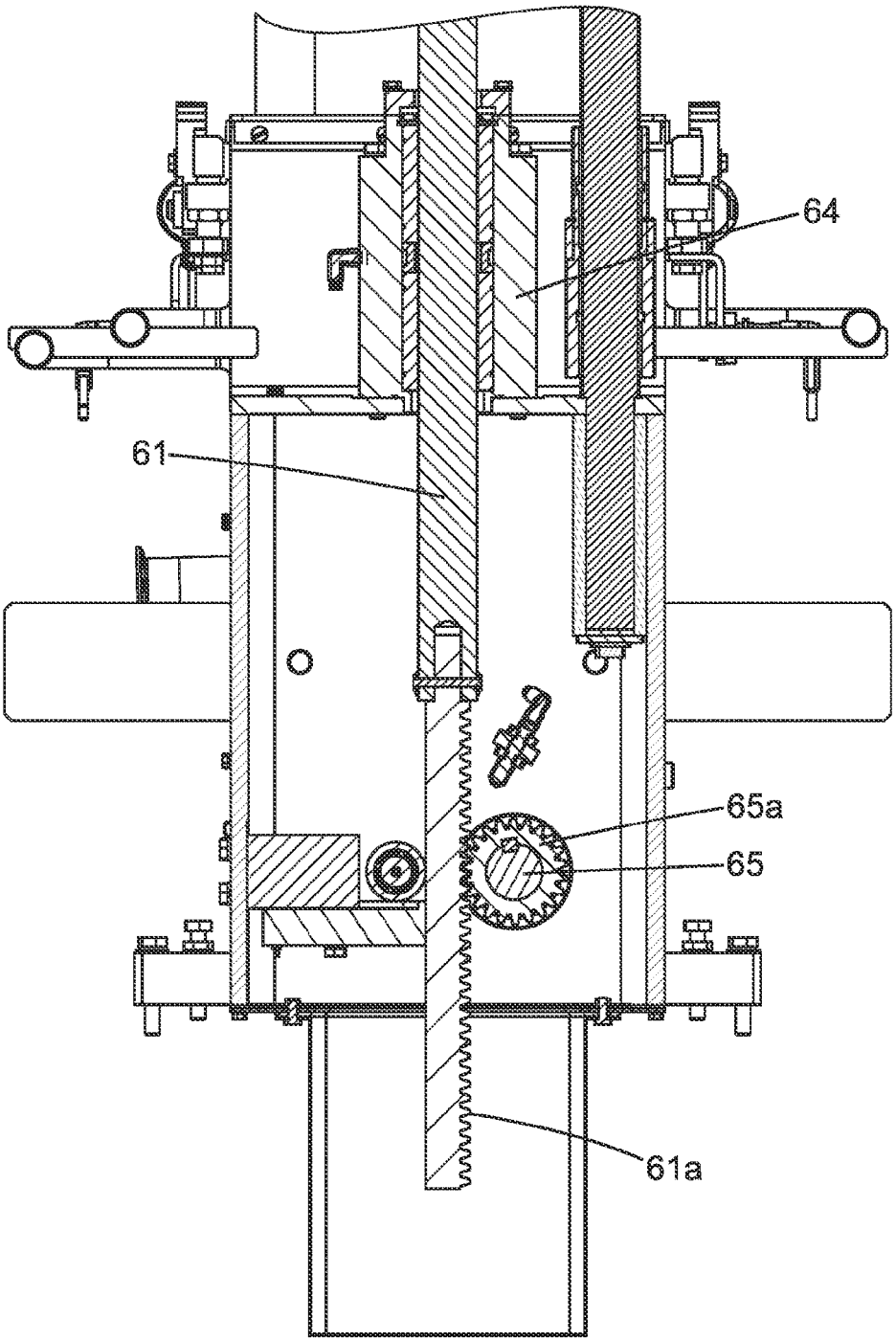
FIG. 9 is a section view of the cup filling device from FIGS. 8A and 8B.

To do that, the device 1 further has a chassis 63 onto which are mounted one or several distribution nozzle(s) 2 and also one or several associated blocking rod(s) 3 and also means of displacement 6 of the blocking rod 3 which are shown in more detail on FIGS. 8A, 8B and 9.

The means of movement 6 are suited for moving the blocking rod 2 between the open, closed, contact and, if applicable, release positions. The means of movement 6 of the blocking rod comprise for example robots controlled by a control unit or a pulley powered by an electric motor (not shown) and connecting rods with which, for example, to convert a circular movement into a translational movement. The means of movement 6 generate for example a movement of vertical translation of the blocking rod 3.

An implementation example of the means of movement is shown in FIGS. 8A, 8B and 9. In this embodiment, the means of movement 6 comprise a motor 60 driving at least one shaft 65. Gears 65*a* placed on the shaft engage with racks 61*a* made in the lower part of control cams 61 of the blocking rod 3 as shown in FIG. 9.

The control cams 61 extend vertically and are guided by the chassis 63 of the cup filling device 1 so as to be able to move in vertical translation along the Z axis. The blocking rods 3 are fixed to the control cams by an upper holding plate 62 that can be seen in FIG. 8B. The distribution nozzles 2 are further attached to the chassis 63, for example by means of the supports 64 of the chassis 63 shown in the FIG. 8B, in particular.

In that way a rotation of the shaft 65 can move the blocking rods 3 relative to the distribution nozzles 2 in the vertical direction between the open, closed, contact and, as appropriate, released positions. In this way, advantageously, the motor 60 and the shaft 65 of the means of displacement 6 can be placed below the device while also controlling the movement of the blocking rods 3 by the upper parts thereof, via the control cams 61 and the upper holding plate 62. In this way also, it is possible to obtain a large vertical movement amplitude from blocking rods 3 while also limiting the dimensions of the device 1.

For being attached to the means of displacement 6, the blocking rod 3 may comprise an upper end 3*c* received in a grasping element of the means is displacement 6, for example by means of a throat.

The blocking rod 3 can in particular be cylindrical apart from the lower end 3*a* thereof and the upper end 3*c* thereof, in particular a cylinder of revolution.

Figure 2:
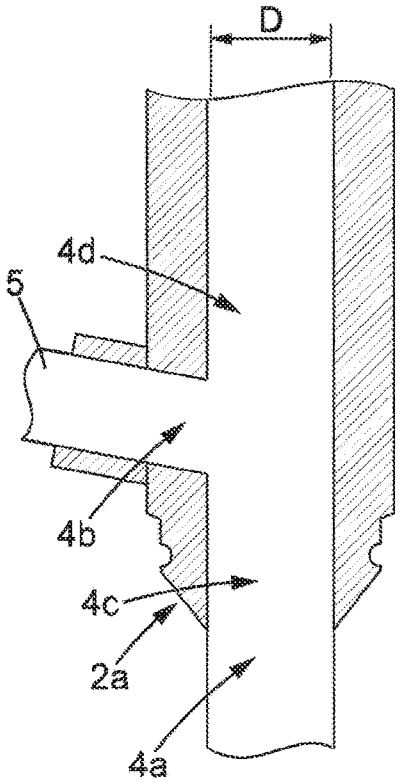
FIG. 2 is a detailed view of the cup filling device from FIG. 1.

The blocking rod 3 is shown in the open position in FIGS. 1 and 2. In the open position, the blocking rod 3 leaves the distribution portion 4*c* of the central channel 4 clear. In this way, a product flow is allowed from the intake channel 5 to the distribution opening 4*a* through the intake opening 4*b* of the central channel 4.

In the open position, the blocking rod 3 is for example housed in the central channel 4. More precisely, as shown in FIG. 1, the central channel 4 has, for example, a guiding portion 4*d* located upstream from the distribution portion 4*c* of the central channel 4, visible in particular in FIG. 2.

"A guiding portion located upstream from the distribution portion" is understood to mean in particular that the guiding portion is located above the distribution portion, or else is farther from the distribution opening of the central channel than the distribution portion. The guiding portion can in particular be a portion of the central channel that is not intended to receive product, even if the lower end thereof can sometimes come into contact with product rising from the distribution portion, in particular when the blocking rod rises in the nozzle above the intake opening.

In the open position of the blocking rod 3, the lower end 3*a* of the blocking rod 3 is thus for example received in the guiding portion 4*d* of the central channel 4 and leaves the distribution portion 4*c* of the central channel 4 clear of obstacles.

Figure 3:
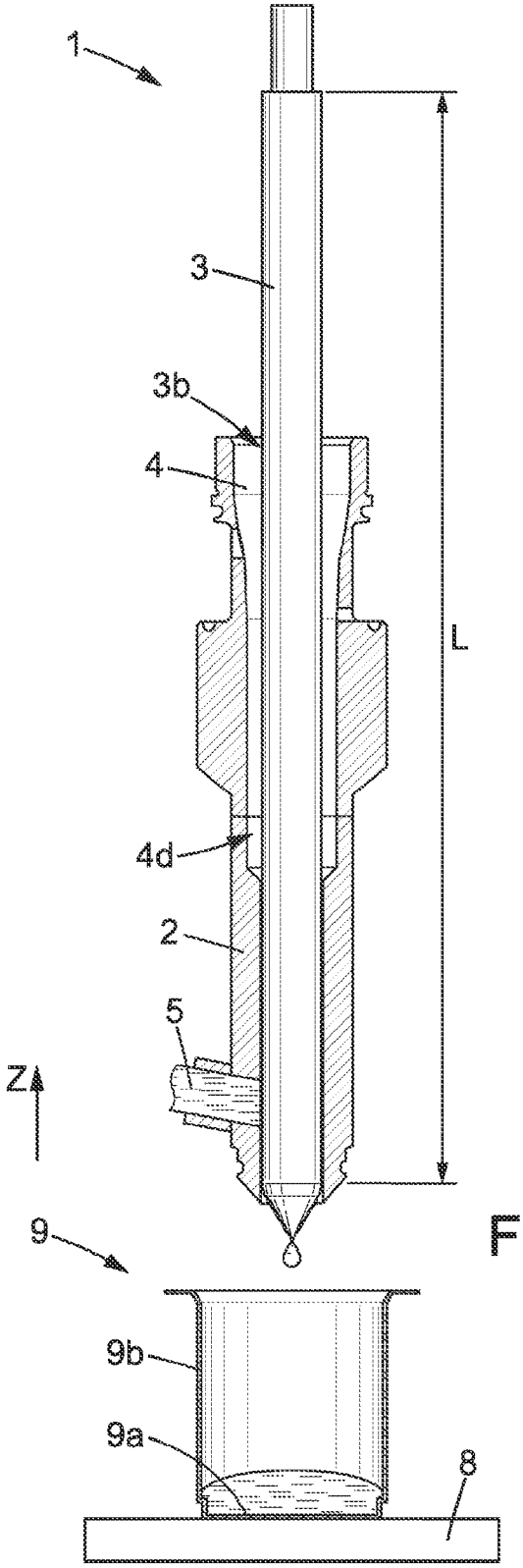
FIG. 3 shows in sectional side view a distribution nozzle and a blocking rod for a cup filling device conforming to the invention with the blocking rod in a closed position.
Figure 4:
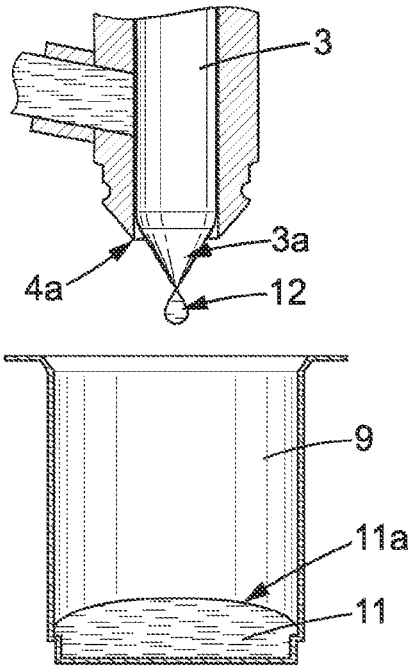
FIG. 4 is a detailed view of the cup filling device from FIG. 3.

The FIGS. 3 and 4 show the blocking rod 3 in the closed position. In the closed position, the blocking rod 3 blocks the distribution portion 4*c* of the central channel 4 so as to prevent a flow of product from the intake channel 5 to the distribution opening 4*a*, through the intake opening 4*b* of the central channel 4.

In the closed position of the blocking rod 3, the lower end 3*a* of the blocking rod 3 can for example be received in the distribution portion 4*c* of the central channel 4.

As a variant, the lower end 3*a* of the blocking rod 3 can be arranged outside of the distribution nozzle 2, in particular arranged outside of the distribution nozzle 2 and near the lower end 2*a* of the distribution nozzle 2.

Thus, the lower end 3*a* of the blocking rod 3 can for example be arranged outside the distribution nozzle 2 and at a distance from the lower end 2*a* of the distribution nozzle 2, measured along the vertical direction Z, of less than 2 cm, preferably less than 15 mm.

More precisely, the blocking rod 3 can comprise, upstream from the lower end 3*a*, a cylindrical blocking portion 3*b* suited for blocking the distribution portion 4*c* of the central channel 4 of the distribution nozzle 2 when the blocking rod is in the contact position and in the closed position.

In an embodiment, the blocking portion 3*b* can have a shape suited for blocking the intake opening 4*b* of the central channel 4 when the blocking rod is in the contact position and in the closed position. The blocking portion 3*b* can for example have the shape of a cylinder of revolution. The intake opening 4*b* can then have the shape of a disk.

In a variant, which could be combined with the previously described embodiment, a section of the blocking portion 3*b*, taken perpendicularly to the vertical direction Z, can be substantially identical to a section of the distribution portion 4*c* of the central channel 4, in particular substantially identical with a sufficiently reduced radial play for allowing a proper seal between the distribution nozzle 2 and the blocking rod 3.

"A section of the blocking portion can be substantially identical to a section of the distribution portion," is understood in particular to mean that the section of the blocking portion can have dimension sufficiently close to the dimensions of a section of the distribution portion for blocking the passage of the product when said sections are coaxial and brought into alignment along the vertical direction Z.

Figure 5:
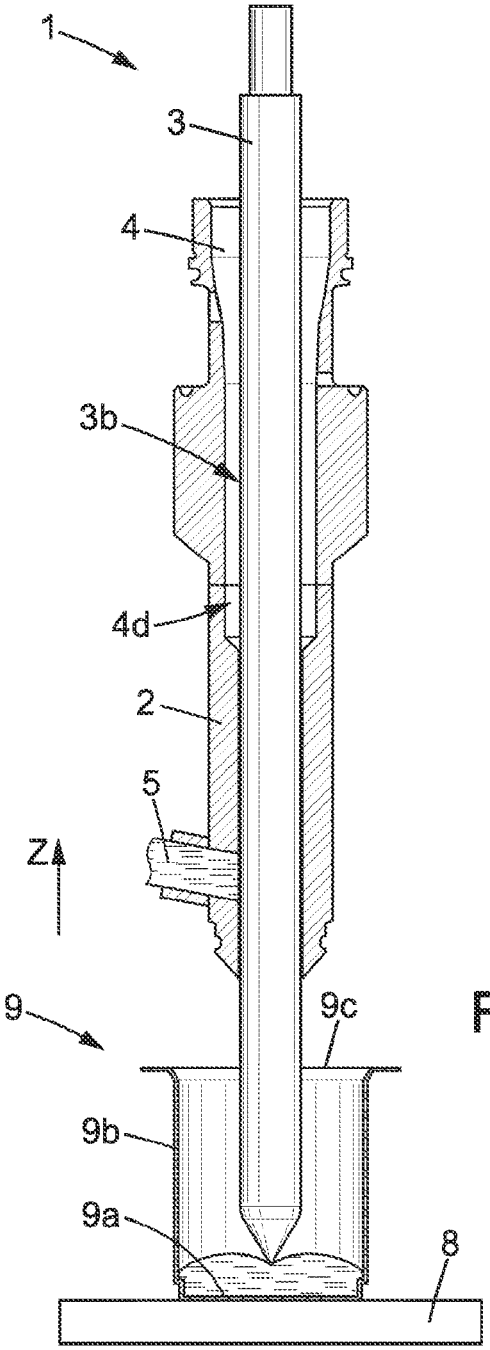
FIG. 5 shows in sectional side view a distribution nozzle and a blocking rod for a cup filling device conforming to the invention with the blocking rod in a contact position.
Figure 6:
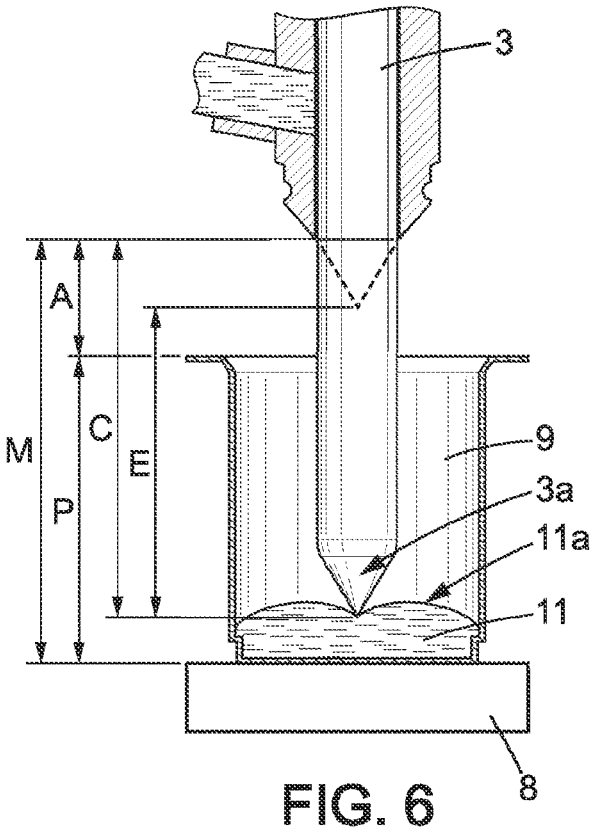
FIG. 6 is a detailed view of the cup filling device from FIG. 5 in which the blocking rod is shown in contact position by dashed lines and in closed position by dotted lines.

The FIGS. 5 and 6 show the blocking rod 3 in the contact position.

In the contact position, the blocking rod 3 extends out of the distribution nozzle 2 through the distribution opening 4*a* of the central channel 4.

More precisely, in the contact position, the blocking rod 3 extends through the distribution opening 4*a* outside the distribution nozzle 2 over a contact distance C greater than or equal to a maximum transverse dimension D of the blocking rod 3.

The contact distance C is for example measured along the vertical direction C between the distribution opening 4*a* and the lower end 3*a* of the blocking rod 3.

The maximum transverse dimension D of the blocking rod 3 is measured in a plane perpendicular to the vertical direction Z. The maximum transverse dimension D of the blocking rod 3 can thus for example correspond to a larger diameter of the blocking rod 3. In an embodiment, the maximum transverse dimension of the blocking rod 3 can in particular be reached in the area of the blocking portion 3*b*.

In this way, it can in particular be understood that the blocking rod 3 extends through the distribution opening 4*a* outside of the distribution nozzle 2 so as to no longer be immediately close to the distribution opening 4*a*.

Thus, in particular, in an embodiment, the blocking rod, in the contact position, can extend beyond the distribution nozzle 2 over a contact distance C greater than or equal to twice the maximum transverse dimension D of the blocking rod 2, preferably at least four times greater than the maximum dimension.

In particular, with these arrangements, during a method of filling a cup according to the invention the lower end 3*a* of the blocking rod 3 can be brought into contact with the product upper-surface after filling the cup 2 without moving the distribution nozzle 2.

The transverse dimension D of the blocking rod 2 is for example 15 or 18 mm; the contact distance C can for example be of order 100 mm, in particular in the case of a cup containing a heterogeneous product like jam, and of order 37 mm in the case of a complete filled cup.

In an embodiment of the invention, in the contact position, the blocking rod 3 thus extends outside the distribution nozzle 2 over a contact distance C greater than or equal to 5 cm, preferably greater than or equal to 7 cm.

Further, the blocking rod 3 can in particular move from the closed position to the contact position through an extension distance E along the vertical direction Z. The cylindrical blocking portion 3*b* of the blocking rod 3 can then extend along the vertical direction Z through an extension length L greater than or equal to said extension distance E.

In this way in particular, when the blocking rod 3 is in the contact position, the blocking rod 3 further blocks the distribution position 4*c* of the central channel 4 of the distribution nozzle 2, meaning that the cylindrical blocking portion 3*b* is thus suited for blocking the distribution portion 4*c* of the central channel 4 of the distribution nozzle 2 when the blocking rod is in the contact position and in the closed position.

Thus in particular, the distribution nozzle 2 can for example extend along the vertical direction Z over a nozzle extension length B and the blocking rod 3 can for example extend along the vertical direction Z over a rod extension length T.

The rod extension length T can then be greater than the nozzle extension length B, and preferably greater than the nozzle extension length B by at least one times a maximum transverse dimension D of the blocking rod 3. Even more preferably, the rod extension length T can be greater than the nozzle extension length B by at least two times a maximum transverse dimension D of the blocking rod 3.

Figure 7:
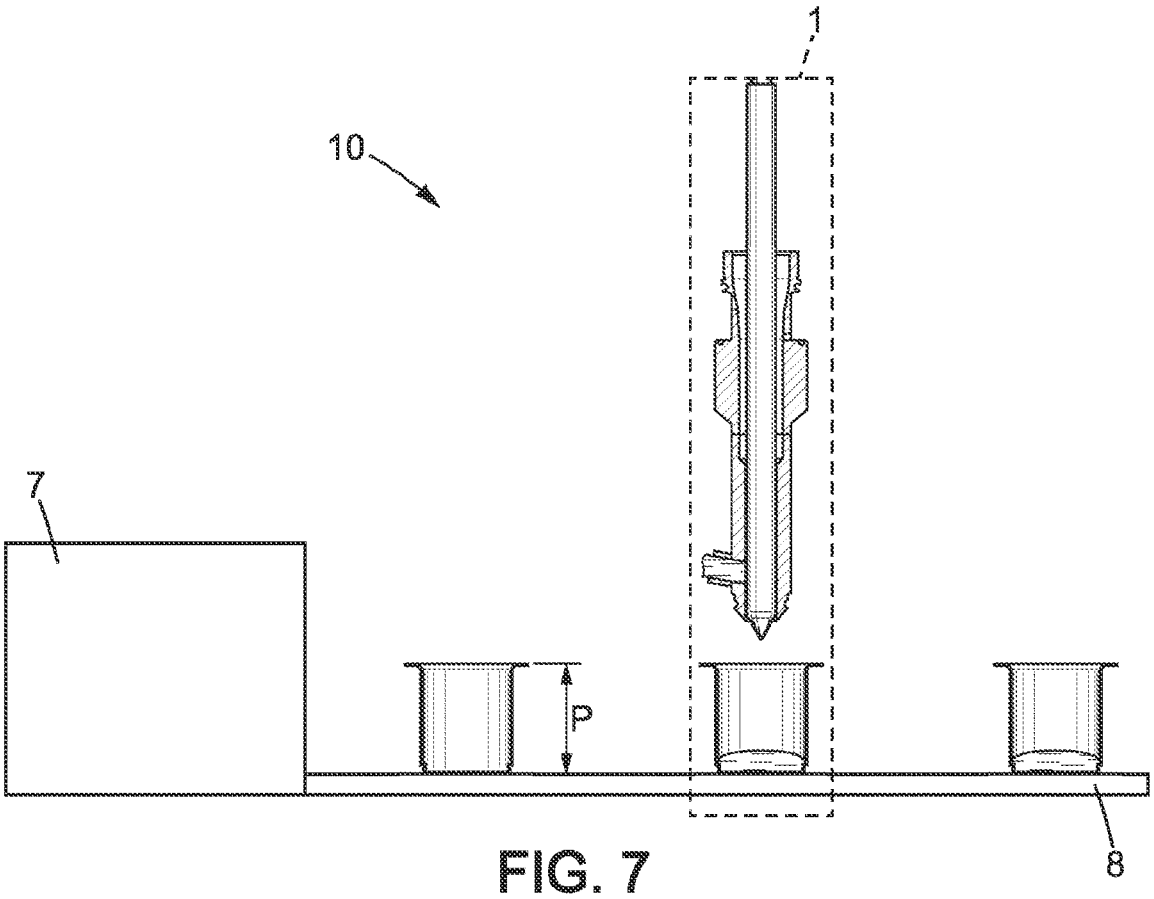
FIG. 7 shows in sectional side view a cup packaging line comprising means for producing cups and means for conveying and holding, and a cup filling device according to the invention with the blocking rod in a released position.

Finally, the blocking rod 3 can also be brought into a released position shown in FIG. 7.

In an embodiment of the released position of the blocking rod 3, the lower end 3*a* of the blocking rod 3 is received in the central channel 4 of the distribution nozzle 2. In this way, the lower end 3*a* of the blocking rod 3 does not extend past the distribution nozzle 2 so that a cup present vertically with the distribution nozzle 2 can in particular be moved without risk of bumping the blocking rod 3.

In a variant of the released position of the blocking rod 3, the lower end 3*a* of the blocking rod 3 is arranged outside of the distribution nozzle 2, in particular arranged outside of the distribution nozzle 2 and near the lower end 2*a* of the distribution nozzle 2.

Thus, for example, the lower end 3*a* of the blocking rod 3 can be arranged outside the distribution nozzle 2 and at a release distance from the lower end 2*a* of the distribution nozzle 2, measured along the vertical direction Z, of less than 2 cm, preferably less than 15 mm.

In general, in the released position, the blocking rod 3 extends outside the distribution nozzle 2 over a release distance less than the contact distance C over which the blocking rod 3 extends in the contact position.

In an embodiment of the invention, the closed position and the released position of the blocking rod 3 can in particular be identical.

Such a filling device 1 can in particular be incorporated in a packaging line 10 which further comprises means for producing cups 7 and means for conveying and holding 8.

The means for producing cups 7 are able to shape a plastic sheet to get at least one cup 9, for example of the type having a bottom wall 9*a*, a lateral wall 9*b* closed on itself, and a top opening 9*c*.

Such means for producing cups 7 are further known and include for example a machine for shaping a plastic sheet and a cutting machine. The machine for shaping a plastic sheet comprises for example suitable molds, sheet guiding rollers and also any known device for producing cups.

The means for conveying and holding 8 are suited, first, to bring and hold at least one cup 9 vertically with and opposite the distribution opening 4*a* of at least one distribution nozzle 2 of the device 1. The means for conveying and holding 8 are suited, second, to move said cup 9 aside from the vertical of said distribution opening 4*a* of the distribution nozzle 2 and to clear said cup 9.

Such means for conveying and holding 8 are also known and comprise for example, cylinders, moving plates, cams, suction cups, guides and robots.

Such a filling device 1 and such a cup packaging line 10 can in particular be intended to implement a filling method according to the invention which is now going to be described in greater detail.

In such a method, first there is a cup filling device 1 such as described above, incorporated as needed in a packaging line 10 such as described above.

Then a cup 9 is brought and held vertically with and opposite the distribution opening 4*a* of the distribution nozzle 2. To do that, means of conveying and holding 8 of a cup packaging line 10 as described above are implemented.

Next, the blocking rod 3 is brought into the open position and the cup 9 is filled with a product flowing through the distribution opening 4*a* of the distribution nozzle 2.

Advantageously, distribution nozzle 2 is arranged outside the cup 9 while the blocking rod 3 is brought into the open position and while the cup 9 is filled with a product flowing through the distribution opening 4*a* of the nozzle 2. In this way, it is possible to fill cups of any size, without constraints on the diameter of the distribution opening of the distribution nozzle and therefore without constraints on the content of the cup, in particular solid products like fruits, dry products, etc.

More generally, the distribution nozzle 2 can advantageously not go inside the cup 9 at any time during implementation of the method.

Thus, for example, the distribution nozzle 2 can remain immobile relative to the cup 9 along the vertical direction Z while the blocking rod 3 is brought into the open position and while the cup 9 is filled with a product flowing through the distribution opening 4*a*.

When a preferred quantity of product is present in a cup 9, the blocking rod 3 is brought into the closed position so as to stop filling of the cup 9.

The situation shown in FIGS. 5 and 6 in which the preferred quantity of product is present in the cup 9 then results.

"Preferred quantity of product" is understood to mean a quantity of product previously chosen by an operator, for example a quantity of product completely filling the cup while leaving a margin allowing movement of the open cup without splashes and/or transport of the cup without splashes of the product on a cover of the cup. It can also mean a quantity of product less than a quantity of product fully filling the cup, for example if the cup is intended to contain a multilayer content, in particular a heterogeneous content.

When the preferred quantity of product is present in the cup, said quantity of product then forms a product layer 11 in the cup 9 as shown in FIG. 4. Said product layer 11 has a product upper-surface 11*a* opposite from and vertically with the distribution opening 4*a* of the distribution nozzle 2.

As shown in FIGS. 5 and 6, the blocking rod 3 is then brought into the contact position in which the blocking rod 3 extends out of the distribution nozzle 2 through the distribution opening 4*a* such that a lower end 3*a* of the blocking rod 3 comes in contact with the product upper-surface 11*a*.

In the example from FIG. 5, the cup 9 is of the type having a bottom wall 9*a*, a lateral wall 9*b* closed on itself, and a top opening 9*c*. In the contact position, the blocking rod 3 thus goes inside the cup 9 through the top opening 9*c*, and the lower end 3*a* of the blocking rod 3 is surrounded by the lateral wall 9*b* of the cup 9.

In this case in particular, the cup packaging line 10 can be such that a separation A, measured along the vertical direction Z, between, first, the top opening 9*c* of a cup 9 brought and held vertically with and opposite the distribution opening 4*a* of the distribution nozzle 2 of the device 1 and, second, the lower end 2*a* of said distribution nozzle 2 is less than the contact distance C over which the blocking rod 3 extends in the contact position.

To do that, the means for producing cups 7 can be arranged for producing empty cups 9 with height P whereas the cup filling device 1 and the means for conveying and holding 8 can be arranged in order to be respectively spaced from each other by a minimum distance M along the vertical direction. The height P and the distance M can then be such that $M-P \leq C$.

In this way, the blocking rod 3 in the contact position thus goes inside the cup 9 through the top opening 9*c*, and the lower end 3*a* of the blocking rod 3 is surrounded by the lateral wall 9*b* of the cup 9.

As indicated above and shown in FIGS. 3 and 4, when the blocking rod 3 is brought from the open position to the closed position, the residual product 12 can remain present in the central channel 4 of the distribution nozzle 2, in particular near the distribution opening 4*a* or on the lower end 3*a* of the blocking rod 3.

When the blocking rod 3 is then brought from the closed position to the contact position shown in FIG. 5, the lower end 3*a* of the blocking rod 3 passes through all of the distribution portion 4*c* of the central channel 4. The blocking rod 3 then withdraws the residual product which could be present in the central channel 4 of the distribution novel 2, where said residual product 12 is found, if any, at the lower end 3*a* of the blocking rod 3.

Then, when the lower end 3*a* of the blocking rod 3 comes into contact with the product upper-surface 11*a*, the residual product 12 which could be present on the lower end 3*a* of the blocking rod 3 comes to coalesce or merge with the product layer 11 in the cup 9 under the effect of the surface tension and leaves the lower end 3*a* of the blocking rod 3.

In this way, the presence of residual product in the central channel 4 or on the lower end 3*a* of the blocking rod 3 is avoided and the phenomenon of parasitic dripping is thus reduced.

For this purpose, the lower end 3*a* of the blocking rod 3 can have a shape suited for reducing the presence of residual product on the lower end 3*a* of the blocking rod 3 and/or reducing the contact surface with the residual product. Thus, for example, the lower end 3*a* of the blocking rod 3 can have a conical shape. Said conical shape for example ends in a rounded point as shown in FIG. 1.

Similarly, in an advantageous embodiment, the blocking rod 3 can be solid. Thus, for example, the blocking rod 3 can be free of distribution openings. In this way also, the presence of residual product on the blocking rod 3 can be reduced.

Further, advantageously the blocking rod can be brought from the open position to the closed position and then from the closed position to the contact position by means of a single, uninterrupted movement of vertical translation of the blocking rod from the open position to the contact position. In this way, the presence of residual product in the central channel 4 or on the lower end 3*a* of the blocking rod 3 is again further avoided. In this way also, the tempo of operation of the device and implementation of the method is also accelerated.

During a subsequent step, the blocking rod 3 can then be brought into a released position shown in FIG. 7.

In the released position, the blocking rod 3 leaves the cup 9 free to be moved, in particular free to be moved in a horizontal plane H perpendicular to the vertical direction Z. In the released position, the blocking rod 3 no longer goes inside the cup 9 and is in particular above the top opening 9*c* of the cup 9.

Further, in the released position, the blocking rod 3 also blocks the distribution portion 4*c* of the central channel 4 so as to prevent the flow of product from the intake channel 5 to the distribution opening 4*a*.

The cup 9 can then be moved aside from the vertical of the distribution opening 4*a* of the distribution nozzle 2 and be cleared 9.

Finally, after having moved aside the cup 9 from the vertical of the distribution opening 4*a*, another cup 9, for example an empty cup or cup not containing the product distributed by the distribution nozzle, can be brought vertically with and opposite the distribution opening 4*a* of the distribution nozzle 2.

To do that, means of conveying and holding 8 of the cup packaging line 10 as described above are implemented.

Then the steps of the method can be repeated to get a flow of outgoing cups each containing the preferred quantity of product.

The invention claimed is:

1. A method for filling cups, the method comprising:

providing a device comprising at least one distribution nozzle extending along a vertical direction and ending in a lower end, the at least one distribution nozzle comprising a central channel extending along the vertical direction and ending in a distribution opening at the lower end of the distribution nozzle, a product intake channel connecting with the central channel of the at least one distribution nozzle through an intake opening of the central channel, to define a distribution portion of the central channel between the intake opening and the distribution opening of the central channel, a blocking rod at least partially received in the central channel and movable along the vertical direction in the central channel, and a mover configured to move the blocking rod;

moving and holding a cup in vertical relation with and opposite the distribution opening of the distribution nozzle;

bringing the blocking rod into an open position in which said blocking rod leaves the distribution portion of the central channel free to allow a flow of product from the product intake channel to the distribution opening, the cup being filled with the product flowing through the distribution opening of the distribution nozzle until a specific quantity of product is present in the cup;

when the specific quantity of product is present in the cup, bringing the blocking rod into a closed position in which said blocking rod blocks the distribution portion of the central channel to stop the flow of product from the product intake channel to the distribution opening, when the specific quantity of product is present in the cup, said quantity of product forming a layer of product in the cup, said layer of product having a product upper-surface opposite from and in vertical relation with the distribution opening of the distribution nozzle; and bringing the blocking rod into a contact position in which the blocking rod extends out of the distribution nozzle through the distribution opening such that a lower end of the blocking rod comes in contact with the product upper-surface, the lower end of the blocking rod having a conical shape configured to one or more of (i) reduce a presence of residual product on the lower end of the blocking rod, and (ii) reduce a contact surface with the residual product, wherein the presence of the residual product is reduced or avoided after filling the cup, near the distribution opening or on the lower end of the blocking rod.

2. The method according to claim 1, wherein the cup has a bottom wall, a lateral wall closed on itself, and a top opening, and in the contact position, the blocking rod enters inside the cup by the top opening and the lower end of the blocking rod is surrounded by the lateral wall of the cup.

3. The method according to claim 1, wherein, when the blocking rod is in the contact position, the blocking rod further blocks the distribution portion of the central channel of the distribution nozzle.

4. The method according to claim 1, wherein the blocking rod is brought from the open position to the closed position and then brought from the closed position to the contact position by a single, uninterrupted movement of vertical translation of the blocking rod from the open position to the contact position.

5. The method according to claim 1, wherein the distribution nozzle does not go inside the cup during implementation of the method and is immobile relative to the cup along the vertical direction while the blocking rod is brought into the open position and while the cup is filled with the product flowing through the distribution opening of the distribution nozzle.

6. The method according to claim 1, wherein the nozzle is disposed outside the cup while the blocking rod is brought into the open position and while the cup is filled with the product flowing through the distribution opening of the distribution nozzle.

7. The method according to claim 1, wherein, in the open position of the blocking rod, the lower end of the blocking rod is received in the central channel.

8. The method according to claim 1, wherein, in the closed position of the blocking rod, the lower end of the blocking rod is received in the distribution portion of the central channel or is disposed outside of the distribution nozzle and near the lower end of the distribution nozzle.

9. The method according to claim 1, further comprising, after having brought the blocking rod into the contact position:

bringing the blocking rod into a released position in which the blocking rod leaves the cup free to be moved in a horizontal plane perpendicular to a vertical direction and blocks the distribution portion of the central channel to prevent a flow of product from the product intake channel to the distribution opening; and moving the cup aside from a vertical of the distribution opening of the distribution nozzle and clearing the cup after the blocking rod is brought into the released position.

10. The method according to claim 9, wherein, in the released position of the blocking rod, the lower end of the blocking rod is received in the central channel of the distribution nozzle or is disposed outside of the distribution nozzle and near the lower end of the distribution nozzle, and wherein, in the released position, the blocking rod extends outside the distribution nozzle over a release distance less than a contact distance over which the blocking rod extends in the contact position.

11. The method according to claim 9, wherein the closed position and the released position of the blocking rod are identical.

12. The method according to claim 9, wherein, after moving the cup aside from the vertical of the distribution opening of the distribution nozzle, another cup is brought in vertical relation with and opposite the distribution opening of the distribution nozzle; and the method is repeated.

13. A device for filling cups for implementing the method according to claim 1, the device configured to reduce or avoid the presence of the residual product after filling the cup near the distribution opening or on the lower end of the blocking rod, the device comprising:

the at least one distribution nozzle extending along the vertical direction and ending in the lower end, the at least one distribution nozzle comprising a central channel extending along the vertical direction and ending in a distribution opening at the lower end of the distribution nozzle;

the product intake channel connecting with the central channel of the distribution nozzle through the intake opening of the central channel, to define the distribution portion of the central channel between the intake opening and the distribution opening of the central channel;

the blocking rod at least partially received in the central channel and movable along the vertical direction in the central channel between at least:

the open position in which said blocking rod leaves the distribution portion of the central channel free to allow the flow of product from the product intake channel to the distribution opening, and the closed position in which said blocking rod blocks the distribution portion of the central channel to prevent the flow of product from the product intake channel to the distribution opening;

the mover configured to move the blocking rod between at least the open position and the closed position;

wherein the blocking rod is placeable in the contact position in which the blocking rod extends through the distribution opening outside of the distribution nozzle over a contact distance measured along the vertical direction between the distribution opening and the lower end of the blocking rod, the contact distance being greater than or equal to a maximum transverse dimension of the blocking rod measured in a plane perpendicular to the vertical direction such that the lower end of the blocking rods comes in contact with the product upper-surface, the lower end of the blocking rod having the shape configured to reduce the presence of residual product on the lower end of the blocking rod, and the mover is configured to bring the blocking rod into the contact position.

14. The device according to claim 13, wherein, in the contact position, the blocking rod extends outside the distribution nozzle over the contact distance greater than or equal to twice the maximum transverse dimension of the blocking rod.

15. The device according to claim 13, wherein the blocking rod comprises, upstream from the lower end of the blocking rod, a cylindrical blocking portion configured to block the distribution portion of the central channel of the distribution nozzle when the blocking rod is in the contact position and in the closed position, the cylindrical blocking portion being configured to block the intake opening of the central channel when the blocking rod is in the contact position and in the closed position.

16. The device according to claim 15, wherein the blocking rod moves between the open position and the contact position through an extension distance along the vertical direction, and wherein the cylindrical blocking portion of the blocking rod extends along the vertical direction over an extension length greater than or equal to said extension distance.

17. The device according to claim 15, wherein a section of the cylindrical blocking portion of the blocking rod, taken perpendicular to the vertical direction, is substantially identical to a section of the distribution portion of the central channel of the distribution nozzle.

18. The device according to claim 13, wherein the distribution nozzle extends along a vertical direction over a nozzle extension length, the blocking rod extends along the vertical direction over a rod extension length that is greater than the nozzle extension length.

19. The device according to claim 13, wherein, in the contact position, the blocking rod extends outside the distribution nozzle over the contact distance greater than or equal to 5 cm.

20. The device according to claim 13, wherein the blocking rod does not have distribution openings.

21. A cup packaging line comprising:

a cup producing system configured to shape a plastic sheet to get at least one cup of the type having a bottom wall, a lateral wall closed on itself, and a top opening;

the device to fill cups according to claim 13; and a conveyor configured to convey and hold the at least one cup in vertical relation with and opposite the distribution opening of at least one distribution nozzle of the cup filling device, and configured to move said at least one cup aside from the vertical of said distribution opening of the distribution nozzle and to clear said at least one cup.

22. The cup packaging line according to claim 21, wherein the cup producing system, the device to fill cups, and the conveyor are disposed such that a separation, measured along the vertical direction between (i) the top opening of one of the at least one cup brought and held in vertical relation with and opposite the distribution opening of the at least one distribution nozzle of the device and (ii) the lower end of said distribution nozzle is less than the contact distance over which the blocking rod extends in the contact position, such that the blocking rod in the contact position enters inside the cup by the top opening, where the lower end of the blocking rod is surrounded by the lateral walls of the cup.

* * * * *